US010060073B2

(12) United States Patent
Praechter et al.

(10) Patent No.: US 10,060,073 B2
(45) Date of Patent: Aug. 28, 2018

(54) METHOD OF LAUNDERING INDUSTRIAL GARMENTS

(71) Applicant: Washing Systems, LLC

(72) Inventors: Matt Praechter, Monroe, OH (US); Roy Praechter, Cincinnati, OH (US); Dave Tibbitts, Mason, OH (US)

(73) Assignee: Washing Systems, LLC, Cincinnati, OH (US)

( * ) Notice: Subject to any disclaimer, the term of this patent is extended or adjusted under 35 U.S.C. 154(b) by 0 days.

(21) Appl. No.: 14/228,915

(22) Filed: Mar. 28, 2014

(65) Prior Publication Data

US 2014/0345062 A1 Nov. 27, 2014

Related U.S. Application Data

(60) Provisional application No. 61/826,540, filed on May 23, 2013.

(51) Int. Cl.

| | |
|---|---|
| ***D06L 1/22*** | (2006.01) |
| ***D06L 1/00*** | (2017.01) |
| ***C11D 3/36*** | (2006.01) |
| ***C11D 7/36*** | (2006.01) |

(52) U.S. Cl.

CPC ..... *D06L 1/22* (2013.01); *C11D 3/361* (2013.01); *C11D 7/36* (2013.01); *D06L 1/00* (2013.01)

(58) Field of Classification Search

CPC .... C12N 9/00; D06L 1/22; D06L 1/00; C11D 3/361; C11D 7/36

USPC ..... 510/392

See application file for complete search history.

(56) References Cited

U.S. PATENT DOCUMENTS

| | | | | |
|---|---|---|---|---|
| 4,440,646 | A | 4/1984 | Budnick | |
| 4,457,857 | A | 7/1984 | Sepulveda et al. | |
| 4,935,065 | A * | 6/1990 | Bull | C11D 3/36 134/22.13 |
| 5,213,624 | A * | 5/1993 | Williams | C11D 17/0021 134/1 |
| 8,535,927 | B1 * | 9/2013 | Jones et al. | 435/212 |
| 2009/0200234 | A1 * | 8/2009 | Schacht | B01D 65/02 210/636 |

FOREIGN PATENT DOCUMENTS

| | | | |
|---|---|---|---|
| CA | 2213633 | | 9/1996 |
| CA | 2226105 | | 1/1997 |
| CA | 2270717 | | 5/1998 |
| CA | 2272396 | | 5/1998 |
| CA | 2305321 | | 4/1999 |
| CA | 2305323 | | 4/1999 |
| CA | 2347228 | | 5/2000 |
| WO | WO9949009 | * | 9/1999 |
| WO | WO2005052146 | * | 6/2005 |

OTHER PUBLICATIONS

Canadian Office Action dated May 7, 2015 (6 pages).
European Search Report dated Mar. 24, 2015 (8 pages).

* cited by examiner

*Primary Examiner* — Vasudevan S Jagannathan
*Assistant Examiner* — Preeti Kumar
(74) *Attorney, Agent, or Firm* — Wood Herron & Evans LLP

(57) ABSTRACT

Metallic based oily soils can be removed from garments by subjecting the garments to a pre-wash in an aqueous solution of a hydroxy diphosphonic acid such as HEDP under acidic conditions. Pre-washing the garments in the aqueous solution of HEDP at about 100 to 212 degrees Fahrenheit for about 15 minutes effectively removes the greasy soils, allowing them to be further laundered with an alkaline detergent composition.

6 Claims, 1 Drawing Sheet

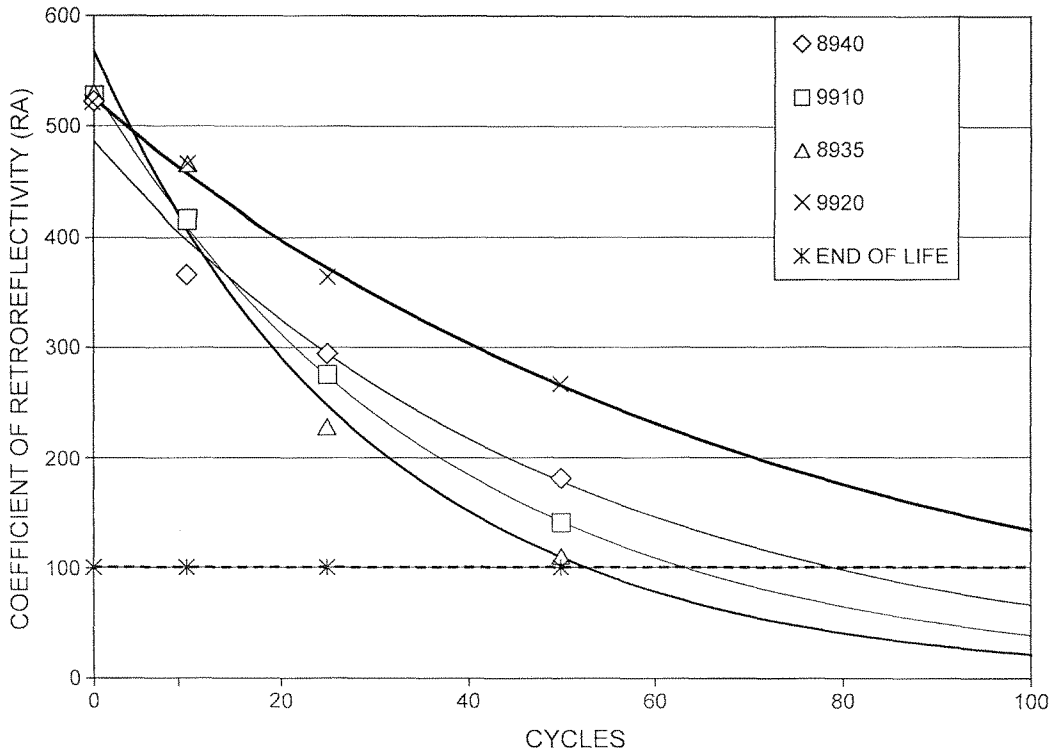
8940
9910
8935
9920
END OF LIFE
COEFFICIENT OF RETROREFLECTIVITY (RA)
600
500
400
300
200
100
0
0
20
40
60
80
100
CYCLES

METHOD OF LAUNDERING INDUSTRIAL GARMENTS

BACKGROUND OF THE INVENTION

The process of removing hydrocarbon-based oily soils from industrial garments is well known. Surfactants are used as a means to remove hydrocarbon based oil, lowering the surface tension at the fabric/soil-water interface and creating an emulsion as the oily soils are lifted from the fabric and suspended in the wash liquor until it can be drained from the wash load. Typically, the surfactant wash process is done under alkaline conditions. A person skilled in the art of developing industrial laundry detergents understands the need and function of surfactants, soils suspending agents, water conditioners and alkali in the successful removal of oily industrial soils. In some cases, though, the oily soil contains a metallic component that is not readily removed via the emulsification process. These types of soils result in residual stains or soils that remain on the garment after being processed.

To resolve this, a pre-wash step has been employed that uses oxalic acid to change the valence of the metal to make it more water soluble. This treatment is generally followed by the normal washing process. Oxalic acid is a moderately strong carboxylic acid with a $pKa_1$=1.27 and $pKa_2$=4.27. Unfortunately, the oxalic acid is a powder and has relatively limited solubility in water (<15 g/100 mL). Therefore, it is impossible to obtain a highly concentrated solution of oxalic acid that is cost effective for dispensing by automatic equipment. As most industrial laundries rely on the accuracy and safety of automatic chemical dispensing equipment, the oxalic acid pre-wash is unsuitable for many laundering facilities. Identifying a compound that is a concentrated (>50%) liquid and can provide the same result as oxalic acid is most desired. Unfortunately, oxalic acid is the only known acid which effectively treats these oily metallic soils.

SUMMARY OF THE INVENTION

The present invention is premised on the realization that oily industrial soils that contain a metallic component can be removed from industrial garments by subjecting the industrial garments to a pre-rinse which includes a hydroxy diphosphonic acid such as 1-hydroxy ethylidene-1, 1-diphosphonic acid (HEDP). The acid prewash step with HEDP is then followed with a standard alkaline laundering using typical detergent surfactants soil suspending agents, water conditioners and alkali. This results in a garment that is cleaner and has fewer metallic based residual stains remaining on the garments. Additionally, the HEDP is available in a solution with greater than 50% solids. Therefore it is suitable for dispensing using automatic dispensing equipment.

The objects and advantages of the present invention will be further appreciated in light of the following detailed description.

BRIEF DESCRIPTION OF TUE DRAWINGS

The FIGURE is a graph showing coefficient of retroreflectivity versus wash cycles for highly reflective tape.

DETAILED DESCRIPTION

According to the present invention, industrial garments are laundered by subjecting the industrial garments to an acidic pre-wash, followed by a rinse step and a subsequent standard alkaline laundering. The pre-wash will include an amount of a hydroxy diphosphonic acid effective to remove metallic based oily soils from the garments prior to subjecting the garments to the standard alkaline industrial wash process.

The soil on any given garment can vary widely. Generally, the present invention is designed to remove soils that might be on garments that are worn in auto repair shops, or machine shops, or the like. These soils will generally have a hydrocarbon portion or a greasy portion and a particulate, gritty, portion such as sand, dirt, or the like. These types of soils frequently have a metallic component, either metallic particles or metallic oxide particles or the like, such as rust. There may also be aluminum or magnesium particles. But, all soils are different, and the various ratios of these components will vary from garment to garment, even if obtained from the same source. HEDP pre-wash treatment has also been found to be quite effective at reducing the Pb on contaminated garments to a safe level, where other acid and/or other chelant treatments have not.

The hydroxy diphosphonic acid must be a water soluble hydroxy diphosphonic acid. Further, it should not have a structure that would provide stearic interference between metal ions and the two phosphoric acid groups. Many diphosphonic acids are disclosed in Budnick U.S. Pat. No. 4,440,646, the disclosure of which is incorporated herein by reference.

A diphosphonic acid which is particularly suitable for use in the present invention is 1-hydroxy ethylidene-1, 1-diphosphonic acid, hereinafter referred to as HEDP. This composition is readily available in a concentrated liquid form. Generally, the concentrated HEDP is available at 58 to 62% actives.

The pre-wash is conducted under acidic conditions but not so acidic as to damage the textiles, as the neutralized diphosphonic acid is not effective in removing metallic based oily soils. As such, the pH should be no higher than 6, generally from 3 to 6, more preferably 3 to 5, and, in one embodiment from 3 to 3.5. Generally, the concentrated HEDP will provide sufficient acidity to establish the pH at 3 to 3.5 without addition of other acids.

The HEDP can be added to the pre-wash at a concentration of 2 ounces per 100 lbs of fabric, up to about 32 fluid ounces per 100 lbs of fabric, at an actives concentration of 58 to 62%. This is from about 1.75 to 20 ounces at a 100% actives level per 100 lbs fabric or a HEDP concentration in the wash liquor of 150-2500 ppm, preferred being 300-1000 ppm. The amount of diphosphonic acid added to the pre-wash is generally determined by the weight of the fabric being laundered.

In addition to the diphosphonic acid, the pre-wash can include a nonionic surfactant, which is optional. The optional nonionic surfactant functions to lower the surface tension between the fabric/soil-water interface allowing the HEDP treated wash liquor to penetrate the fabric and soil more readily but does not provide emulsification of the metallic based soils. Suitable nonionic surfactants for laundry include alcohol alkoxylates, alkyl phenol alkoxylates, and alcohol and alkyl phenol condensates with ethylene oxide/propylene oxide block polymers. The nonionic surfactant can be added from 0 to about 5 ounces per 100 lbs of fabric, generally at about 2 ounces per 100 lbs of fabric.

Other than the non-ionic surfactants, the pre-wash of the present invention typically would not include components found in basic industrial laundry detergent compositions at amounts sufficient to have any intended effect on the garments. In particular, the present invention should not include any alkaline compositions, builders, anionic or cationic surfactants, bleaching agents, or the like. Although the pre-wash could have insignificant amounts of these compositions, none of these compositions should be present in an amount effective to reduce the efficacy of the diphosphonic acid in removing metallic based oily soils or in amounts that these compounds would be typically be added to in a basic laundering process.

The remainder of the pre-wash will simply be water, generally soft water.

To remove the metallic based oily soils according to the present invention, the soiled garments are weighed to proper poundage and loaded into a commercial laundry machine. The washing machine is filled to a low water level (6-9" inches) with fresh soft water. The pre-wash solution is formed by adding the diphosphonic acid, and optionally the nonionic surfactant in the amounts listed above, to the pre-wash water, which is heated to a temperature of 100 to less than 212° Fahrenheit in a commercial laundry machine, generally about 150° F. The garments are agitated by the laundering apparatus for about 5 minutes to about one-half hour, generally about 15 minutes. The agitation is then discontinued, and the pre-wash solution is drained, and the fabric is rinsed with clean fresh water at a high water level (10-16"), which is subsequently drained. The pre-washed wet garments are then immediately subjected to a standard laundering procedure using known alkaline laundry detergent compositions to remove remaining soil.

Thus, by practicing the present invention one can use standard commercial laundry liquid dispensing equipment to provide a pre-wash effective to remove metallic-based soils from laundered fabrics. The pre-wash has a significant effect on the overall appearance of the article subsequent to the regular alkaline wash. The combination of the acid pre-wash and the alkaline wash effectively provides, cleaner, brighter garments.

EXAMPLE

The HEDP pre-treatment process has been tested at three industrial laundries that process heavy soil industrial garments. Soiled shirt swatches were used to evaluate the performance of each test load. A particularly heavily soiled section of a test garment was cut and the soiled area split in half, with each half being processed in either the HEDP pretreatment followed by the standard wash formulas or the standard wash formula only (control). Eight splits are included in each replicate test and at least 3-4 replicate test was performed with each garment type. At the completion of the test, the shirt splits are put back together and are graded visually by three impartial judges using a Panel Score Units (PSU) system (−4 to +4). The HEDP Pre-treatment step used for all test loads can be found in Table 1. The Standard wash formulas used to evaluate 65/35 Polyester/Cotton color shirts, 65/35 polyester/cotton color pants, 100% cotton color shirts and 100% cotton color pants are shown in Tables 2-5. The PSU results from each field test location (averaged over the number of replicate tests) can be found in Tables 6-8 with the higher positive PSU being judged as cleaner than treatments with negative PSU. The greater the PSU span the larger the difference in the two treatments being evaluated.

TABLE 1

HEDP Pre-Treatment process

| Operation | Time | Level | Temperature (° F.) | Supply/100 lbs of fabric |
|---|---|---|---|---|
| Treatment | 10 min. | Low | 120 | Nonionic surfactant- 2 oz. HEDP (55%)- 8 oz. |
| Flush | 2 min. | High | 145 | |
| Flush | 2 min. | High | 145 | |

*Recommended wash formula followed pre-treatment formula.

TABLE 2

Standard 65/35 Colored Shirt wash process

| Operation | Time | Level | Temperature (° F.) | Chemical/CWT |
|---|---|---|---|---|
| Break | 12 min. | Low | 145 | Detergent- 18 oz. Builder- 19 oz. Alkali- 6 oz. |
| Carryover | 3 min. | Low | 145 | |
| Suds | 6 min. | Low | 145 | Detergent- 5 oz. Builder- 5 oz. |
| Rinse | 2 min. | High | 130 | |
| Rinse | 2 min. | High | 115 | |
| Rinse | 2 min. | High | 100 | |
| Sour | 4 min. | Low | 95 | Sour- 1 oz. |
| Extract | 3 min. | | | |

TABLE 3

Standard 65/35 Colored Pants wash process

| Operation | Time | Level | Temperature (° F.) | Chemical |
|---|---|---|---|---|
| Break | 12 min. | Low | 145 | Detergent- 7 oz. Builder- 8 oz. Alkali- 4 oz. |
| Rinse | 2 min. | High | 130 | |
| Rinse | 2 min. | High | 115 | |
| Rinse | 2 min. | High | 100 | |
| Sour | 4 min. | Low | 95 | Sour- 1 oz. |
| Extract | 5 min. | | | |

TABLE 4

Standard Cotton Shirts process

| Operation | Time | Level | Temperature (° F.) | Chemical/CWT |
|---|---|---|---|---|
| Break | 12 min. | Low | 160 | Detergent- 11 oz. Builder - 5 oz. Alkali - 22 oz. |
| Carryover | 3 min. | Low | 145 | |
| Rinse | 2 min. | High | 145 | |
| Rinse | 2 min. | High | 130 | |
| Rinse | 2 min. | High | 115 | |
| Sour | 4 min. | Low | 100 | Sour- 1 oz. |
| Extract | 6 min. | | | |

TABLE 5

| Standard Cotton Pants process | | | | |
|---|---|---|---|---|
| Operation | Time | Level | Temperature (° F.) | Chemical/CWT |
| Break | 12 min. | Low | 145 | Detergent- 10 oz. Alkali- 16 oz. |
| Rinse | 2 min. | High | 140 | |
| Rinse | 2 min. | High | 125 | |
| Rinse | 2 min. | High | 110 | |
| Sour | 4 min. | Low | 95 | Sour- 1 oz. |
| Extract | 6 min. | | | |

TABLE 6

| RESULTS - FIELD TEST Test site OH1 | | |
|---|---|---|
| | Panel Score Units (PSU) | |
| Soiled garment split samples | HEDP treated (TRT 1) | Standard wash (TRT 2) |
| 65/35 Color Shirts (average 4 replicates) | 0.19 | −0.19 |
| 65/35 Color Pants (average 4 replicates) | 0.34 | −0.34 |
| 100% Color Cotton Pants (average 4 replicates) | 0.25 | −0.25 |
| 100% Color Cotton Shirts (average 3 replicates) | 0.06 | −0.06 |

TABLE 7

| RESULTS - FIELD TEST Field Test site OH2 | | |
|---|---|---|
| | Panel Score Units (PSU) | |
| Soiled garment split samples | HEDP treated (TRT 1) | Standard wash (TRT 2) |
| 65/35 Color Shirts (average 3 replicates) | 0.53 | −0.53 |
| 65/35 Color Pants (average 3 replicates) | 0.42 | −0.42 |
| 100% Color Cotton Pants (average 5 replicates) | 0.53 | −0.53 |

TABLE 8

| RESULTS - FIELD TEST Field Test site IN1 | | |
|---|---|---|
| | Panel Score Units (PSU) | |
| Soiled garment split samples | HEDP treated (TRT 1) | Standard wash (TRT 2) |
| 65/35 Color Shirts (average 3 replicates) | 0.08 | −0.08 |
| 65/35 Color Pants (average 4 replicates) | 0.18 | −0.18 |
| 100% Color Cotton Pants (average 6 replicates) | 0.05 | −0.05 |

An additional benefit of processing heavily soiled industrial garments in an acidic pre-treatment of HBO is the extended service life on garments with High Visibility (Hi-Viz) reflective tape. Many times garments with Hi-Viz tape are used in high risk job environments (ie, oil fields, highway mechanics, etc). Many times these garments have flame retardant properties so soil removal is critical. Typical industrial wash formulas designed to remove very heavy oils and greases generally will have a high alkaline component. While this aids in the removal of the soils it damages the reflective nature of the Hi-Viz tapes. Pre-treating these very heavily soiled garments with the HEDP process provides improved cleaning performance while preserving the reflective properties of the tape at least through its expected life of 50 wash cycles. This has been confirmed with 50 wash cycle test in the lab using the HEDP pre-treatment followed by a low alkaline wash on 4 different 3M brand reflective tapes. These are the most common tapes found in the industrial laundry market. At the completion of the multi-cycle wash test, the reflective tapes were returned to 3M for Coefficient of Retroreflectivity. The results are shown below in the FIGURE.

Thus, the present invention effectively removes metallic, oily soil from fabric. Further, this pre-treatment does not significantly adversely impact Hi-Viz tapes. Thus, it can be used to remove oily, metallic soils from garments with Hi-Viz tape. Further, it has been found that this acid pre-treatment effectively removes lead from fabric, thus acting to decontaminate such fabric.

This has been a description of the present invention along with the preferred method of practicing the present invention. However, the invention itself should only be defined by the appended claims, Wherein we claim:

1. A method of laundering garments having metallic-based oily soil including a hydrocarbon portion and at least one of metal particles and metal oxide particles comprising prewashing said garments in an aqueous solution of 1-hydroxy ethylidene-1, 1-diphosphonic acid at about 100° F. to about 212° F. at a pH of 3-5 for a time effective to cause removal of metallic based oily soils and subsequently washing said garments in an alkaline detergent solution; and wherein said aqueous solution of 1-hydroxy ethylidene-1, 1-diphosphonic acid does not include any of alkaline components, detergent builders, anionic surfactant, cationic surfactants or bleach in amounts sufficient to effect said garments during laundering.

2. The method claimed in claim 1 wherein said effective time is from about 5 to about 30 minutes.

3. The method claimed in claim 1 wherein said effective temperature is about 150° F.

4. The method claimed in claim 1 wherein said aqueous solution includes from about 1.75 to about 20 ounces of 1-hydroxy ethylidene-1, 1-diphosphonic acid per 100 lbs of fabric.

5. The method claimed in claim 1 wherein said aqueous solution includes a nonionic surfactant in an amount effective to lower the surface tension between the fabric/soil-water interface and help disperse soils dislodged from said fabric.

6. The method claimed in claim 1 further comprising separating said garments from said aqueous solution of 1-hydroxy ethylidene-1, 1-diphosphonic acid before subjecting said garments to said alkaline detergent solution.

* * * * *